US006401265B1

(12) United States Patent
Kao et al.

(10) Patent No.: US 6,401,265 B1
(45) Date of Patent: Jun. 11, 2002

(54) TOILET SEAT CONSTRUCTION

(75) Inventors: Chi-Chang Kao, No. 18, Huei-Min Rd., Ma-Kung City, Penghu Hsien; Juann-Fa Lin, Kaohusiung, both of (TW)

(73) Assignee: Chi-Chang Kao, Ma-Kung (TW)

( * ) Notice: Subject to any disclaimer, the term of this patent is extended or adjusted under 35 U.S.C. 154(b) by 0 days.

(21) Appl. No.: 09/884,850

(22) Filed: Jun. 19, 2001

(51) Int. Cl.[7] ..... A47K 13/14
(52) U.S. Cl. ..... 4/244.3
(58) Field of Search ..... 4/244.3

(56) References Cited

U.S. PATENT DOCUMENTS 1,159,928 A * 11/1915 Graves ..... 4/244.3
3,967,325 A * 7/1976 Rodriguez ..... 4/244.3
6,006,370 A * 12/1999 Wu ..... 4/244.3

* cited by examiner

*Primary Examiner*—Charles E. Phillips
(74) *Attorney, Agent, or Firm*—Ohlandt, Greeley, Ruggiero & Perle, L.L.P.

(57) ABSTRACT

A toilet seat construction includes a seat member with an upper major surface for holding a stack of pliable seat sheets thereon. A retaining member has a rear portion mounted pivotally and turnable relative to the seat member so as to be superimposed upon the seat member. The retaining member has an opening bordered by two lateral retaining portions. When the retaining member is superimposed upon the seat member, the lateral retaining portions are superimposed upon lateral holding areas of the upper major surface of the seat member, and thus a body contact area of the stack of the pliable seat sheets is urged to protrude out of the opening for contacting the body of the user.

5 Claims, 6 Drawing Sheets

TOILET SEAT CONSTRUCTION

BACKGROUND OF THE INVENTION

1. Field of the Invention

This invention relates to a toilet seat construction, more particularly to a toilet seat construction adapted to retain a stack of pliable seat sheets thereon for convenient use.

2. Description of the Related Art

Generally, a seat sheet is laid on the sitting surface of a toilet seat by the user to prevent direct body contact with the sitting surface of the toilet seat. Since no retaining means for retaining the seat sheet on the sitting surface when the user is seated on the seat sheet, the seat sheet is liable to curl, move, or even drop, thereby resulting in undesired body contact with the sitting surface of the toilet seat.

SUMMARY OF THE INVENTION

The object of the present invention is to provide a toilet seat construction which is adapted to retain a stack of pliable seat sheets so as to ensure clean and sanitary use of a toilet.

According to this invention, the toilet seat construction includes a seat member with a first upper major surface for holding a stack of seat sheets thereon. The first upper major surface includes front and rear portions which are spaced apart from each other in a first direction, and right and left portions which are spaced apart from each other in a longitudinal direction transverse to the first direction and which respectively interconnect the front and rear portions. The first upper major surface defines a raised area which extends along the right, left and front portions, and two lateral holding areas which respectively extend along the right, left and front portions and which flank the raised area. The raised area is disposed higher than the lateral holding areas. The lateral holding areas and the raised area are adapted to be superimposed by lateral retained areas and a body contact area of the stack of the seat sheets, respectively. A retaining member has upper and lower major surfaces opposite to each other in a second direction transverse to both the longitudinal and first directions. The upper major surface of the retaining member includes front and rear portions which are spaced apart from each other in the first direction. The rear portion is pivotally mounted and is turnable relative to the seat member about an axis parallel to the longitudinal direction and between a position of use, where the retaining member is superimposed upon the seat member, and a position of non-use, where the front portion of the retaining member is remote from the front portion of the seat member. The upper major surface of the retaining member further includes right and left portions which are spaced apart from each other in the longitudinal direction, and which respectively interconnect the front and rear portions. The upper major surface of the retaining member defines an opening which extends in the second direction through the lower major surface and which extends along the right, left and front portions to form two lateral retaining portions that border the opening. When the retaining member is in the position of use, the lateral retaining portions are superimposed respectively upon the lateral holding areas while the body contact area is raised by the raised area to protrude out of the opening so as to be adapted to be contacted by the body of the user.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
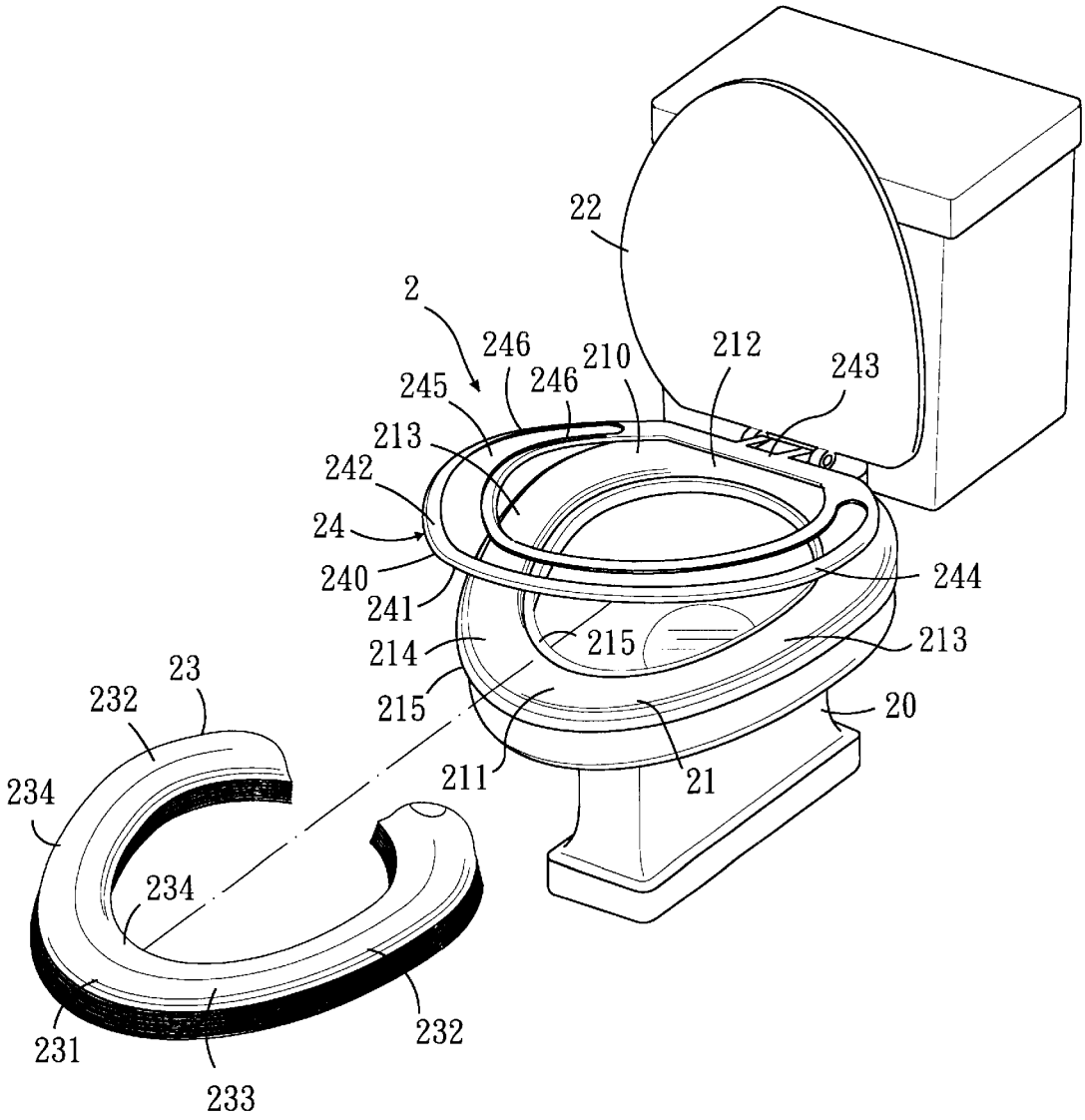
FIG. 1 is a perspective view of a first preferred embodiment of a toilet seat construction according to this invention.
Figure 2:
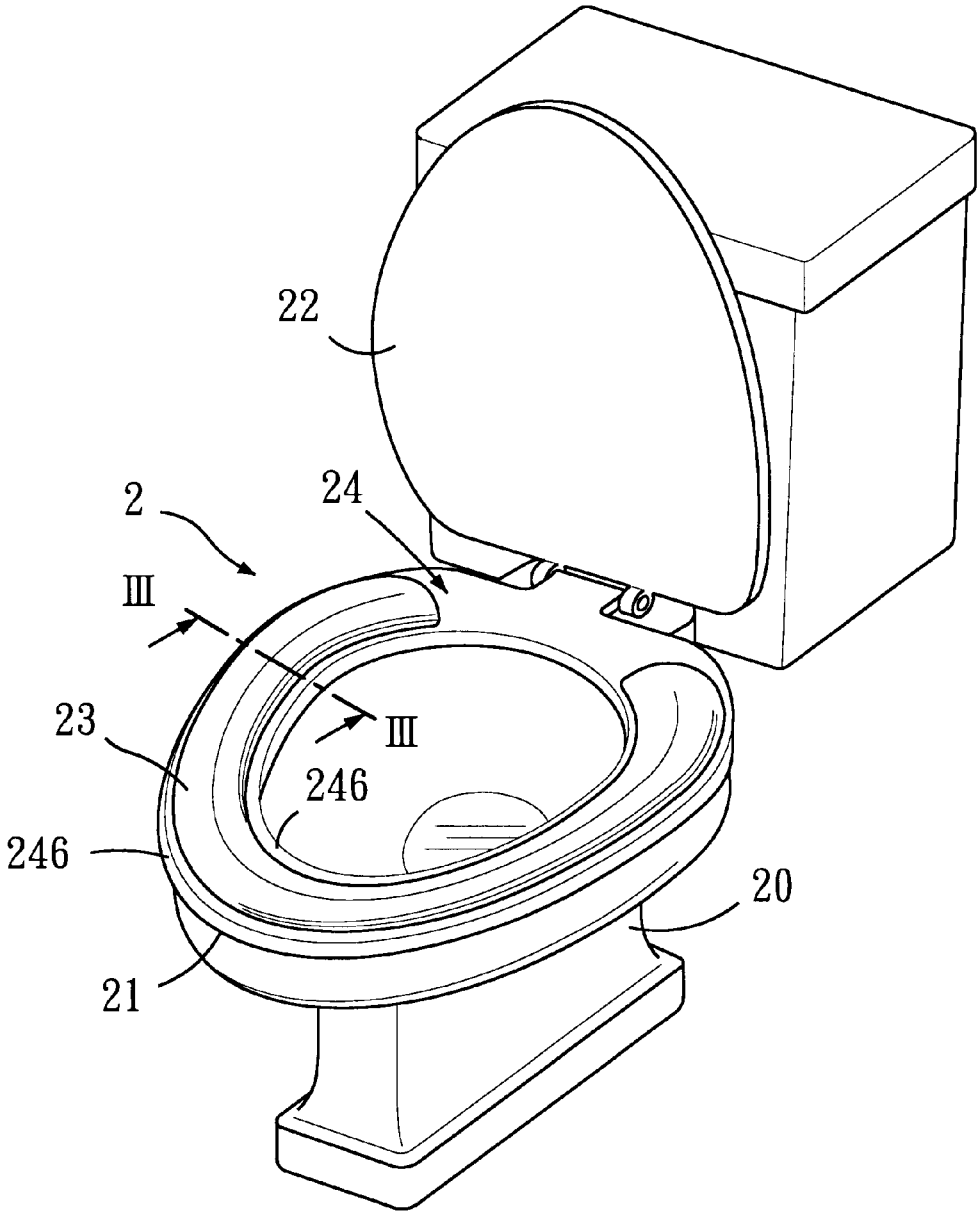
FIG. 2 is an assembled perspective view of the first preferred embodiment.
Figure 3:
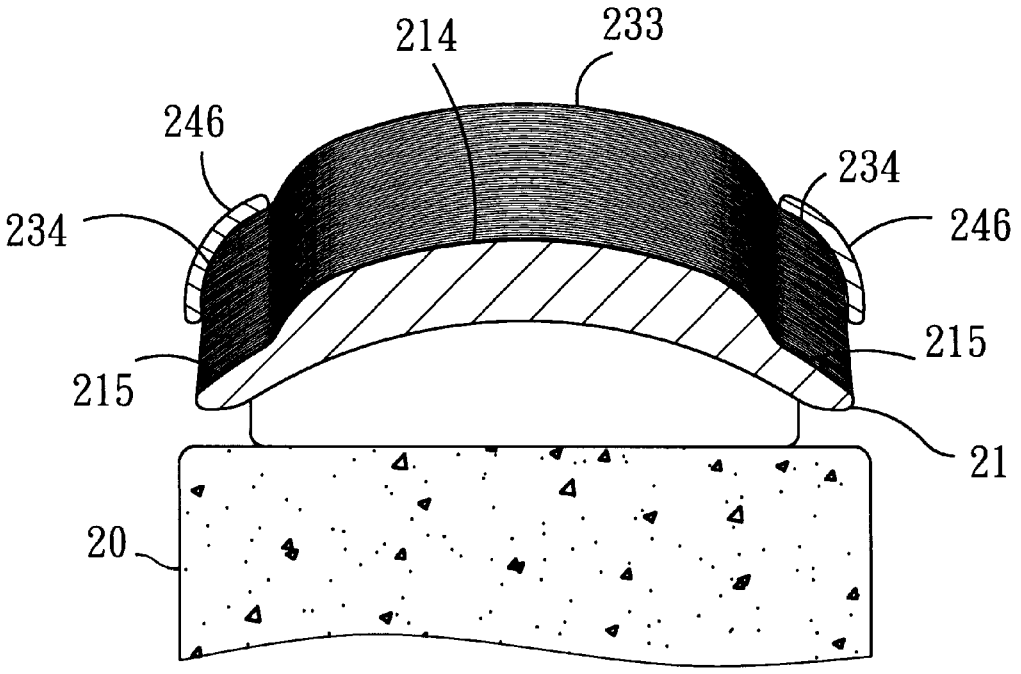
FIG. 3 is a partly cross-sectional view of the toilet seat construction shown in FIG. 2, taken along lines III—III thereof.

Referring to FIGS. 1, 2 and 3, the first preferred embodiment of the toilet seat construction 2 according to the present invention is shown to be adapted to retain a stack of pliable seat sheets 23, and comprises a seat member 21, a lid member 22, and a retaining member 24. The stack of pliable seat sheets 23 includes a first front portion 231 with two first ends, and first right and left portions 232 which respectively extend from the two first ends of the first front portion 231 rearwards and which are spaced apart from each other in a longitudinal direction. In addition, the stack of seat sheets 23 has an uppermost sitting surface which defines a user's body contact area 233 that extends along the first right, left and front portions 232,231, and two lateral retained areas 234 that respectively extend along the first right, left and front portions 232,231 and that flank the body contact area 233.

The seat member 21 has a first upper major surface 210 which includes second front and rear portions 211,212 that are respectively provided with two second front ends and two second rear ends, and that are spaced apart from each other in a first direction transverse to the longitudinal direction, and second right and left portions 213 that are spaced apart from each other in the longitudinal direction and that respectively interconnect the second front ends and the second rear ends. The second rear portion 212 is adapted to be mounted pivotally on a rear part of a toilet main body 20 about an axis in the longitudinal direction. The lid member 22 is mounted pivotally on the rear side of the toilet main body 20 about the axis and has a shape sufficient to cover the entire seat member 21. In addition, the first upper major surface 210 defines a raised area 214 which extends along the second right, left and front portions 213,211, and two lateral holding areas 215 which respectively extend along the second right, left and front portions 213,211 and which flank the raised area 214. The raised area 214 is higher than the lateral holding areas 215. As such, the lateral retained areas 234 and the body contact area 233 of the stack of the seat sheets 23 can be held on the lateral holding areas 215 and the raised area 214, respectively.

The retaining member 24 has second upper and lower major surfaces 240,241 opposite to each other in a second direction transverse to both the longitudinal and first directions. The second upper major surface 240 includes third front and rear portions 242,243 which are respectively provided with two third front ends and two third rear ends, and which are spaced apart from each other in the first direction. The third rear portion 243 is pivotally mounted and is turnable relative to the seat member 21 about the axis and between a position of use, where the retaining member 24 is superimposed upon the seat member 21, and a position of non-use, where the third front portion 242 is remote from the second front portion 211. The second upper major surface 240 further includes third right and left portions 244 which are spaced apart from each other in the longitudinal direction, and which respectively interconnect the third front ends and the third rear ends of the third front and rear portions 242,243.

In addition, the second upper major surface 210 defines an opening 245 which extends in the second direction through the lower major surface 241 and which extends along the third right, left and front portions 244,242 to form two lateral retaining portions 246 that border the opening 245. Thus, when the retaining member 24 is in the used position, the lateral retaining portions 246 are superimposed respectively upon the lateral holding areas 215 of the seat member 21 while the body contact area 233 of the stack of seat sheets 23 is urged by the raised area 214 to protrude out of the opening 245 so as to be adapted to be contacted by the body of the user.

Figure 4:
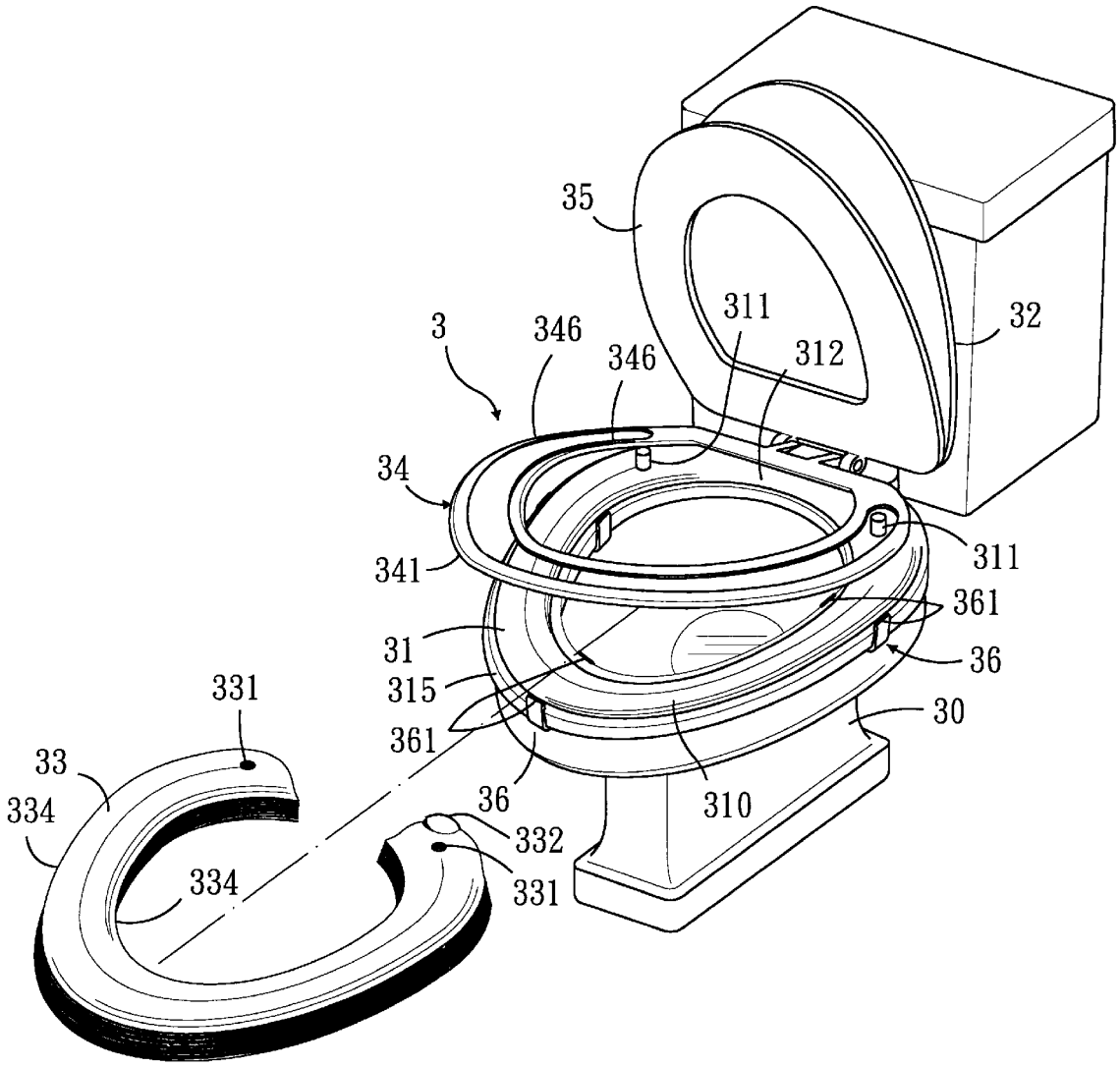
FIG. 4 is a perspective view of a second preferred embodiment of a toilet seat construction according to this invention.
Figure 5:
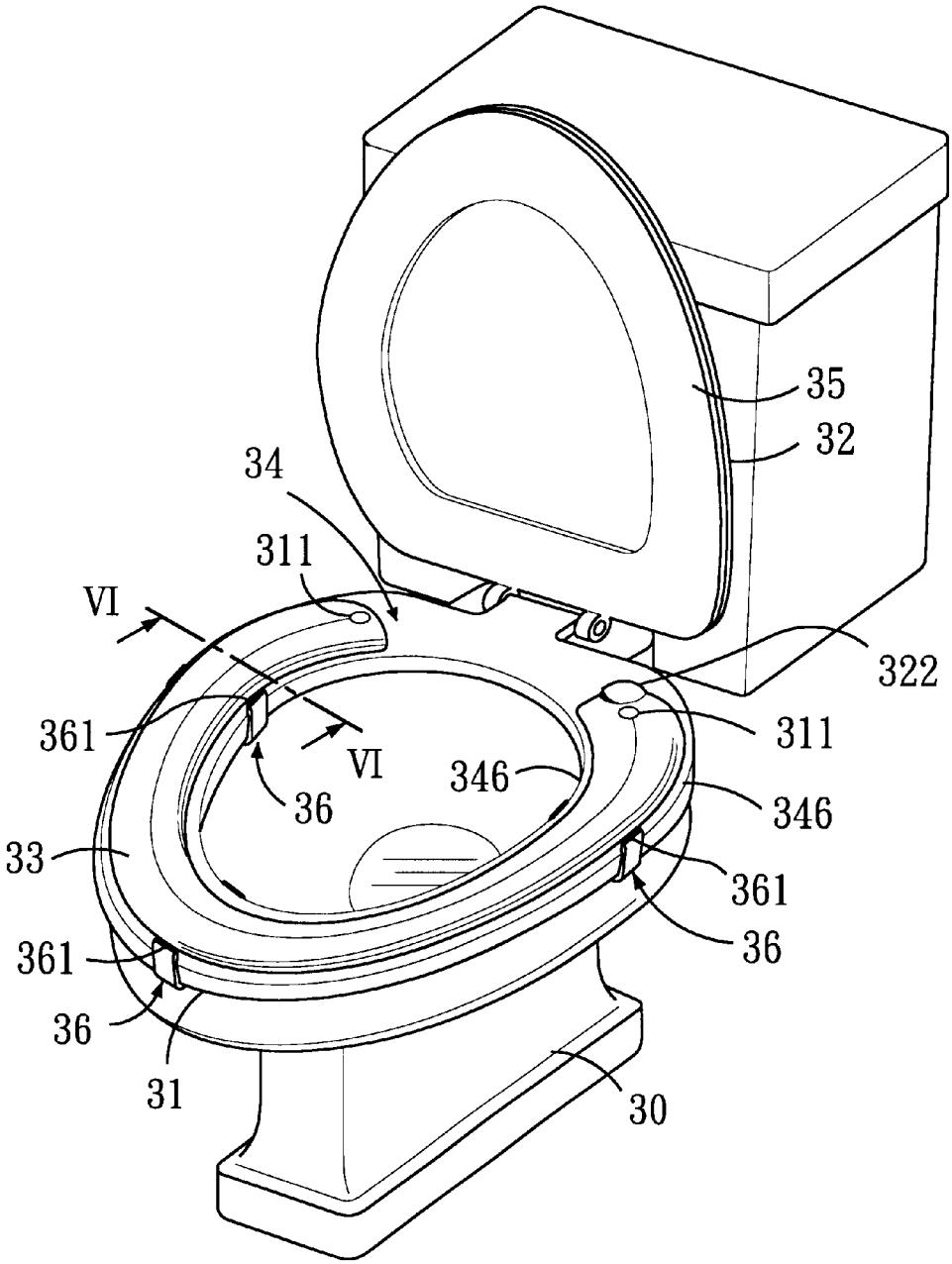
FIG. 5 is an assembled perspective view of the second preferred embodiment.
Figure 6:
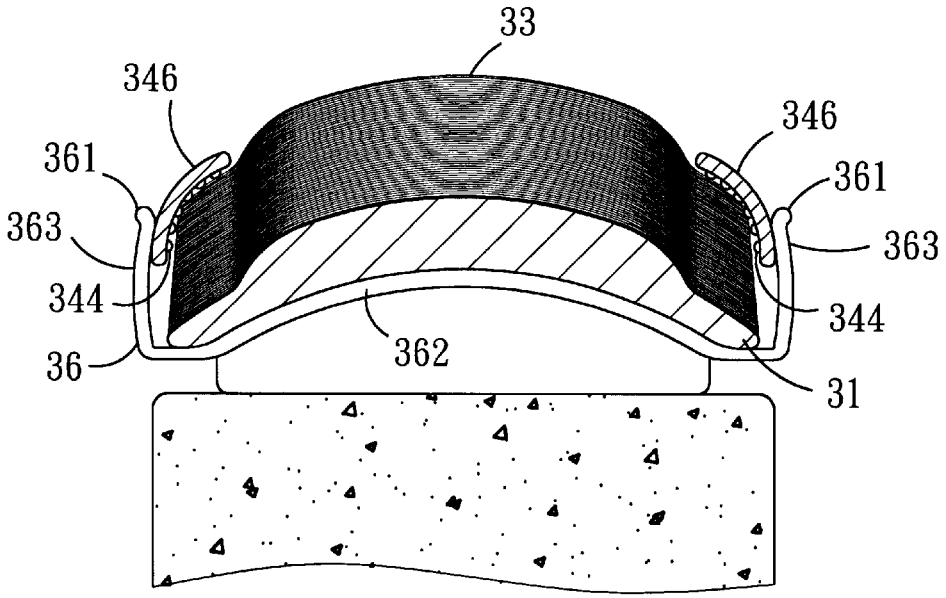
FIG. 6 is a partly cross-sectional view of the toilet seat construction shown in FIG. 5, taken along lines VI—VI thereof.

FIGS. 4, 5 and 6 show the second preferred embodiment of the toilet seat construction according to this invention. In addition to the components of the first preferred embodiment, the retaining member 34 of the toilet seat construction 3 of this embodiment further includes a plurality of protrusions 344 which are formed on the lower major surface 341 and along the lateral retaining portions 346,thereby facilitating removal of a used seat sheet 33 from the seat member 31.

Figure 7:
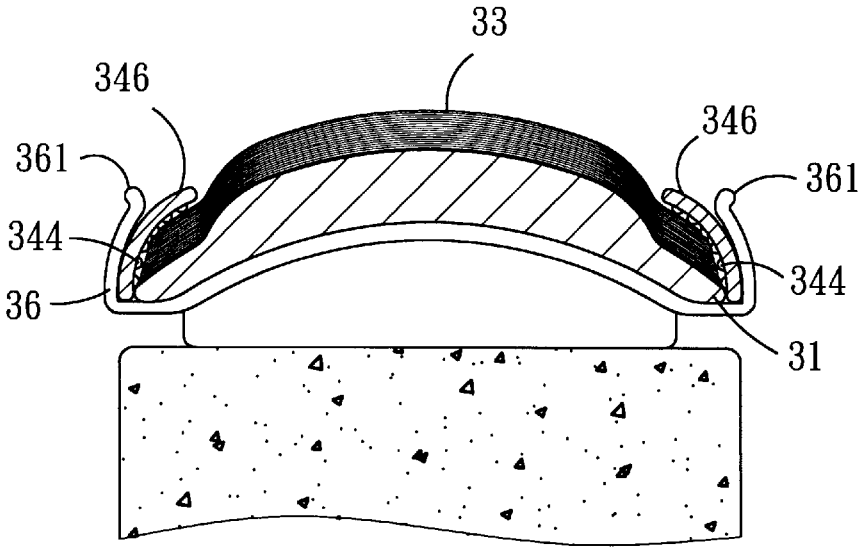
FIG. 7 is a partly cross-sectional view similar to FIG. 6, showing a state of the toilet seat construction when holding a smaller amount of seat sheets.

In addition, the toilet seat construction of this embodiment further comprises a plurality of clamping members 36. With reference to FIG. 6, each clamping member 36 includes a bottom strip 362 which is mounted beneath the seat member 31 and which extends to form two lateral edge portions, and two jaws 363 which extend upwardly from the two lateral edge portions of the bottom strip 362 and which are disposed outboard to the lateral holding areas 315 of the seat member 31. The jaws 363 include two grip tip ends 361 which extend respectively beyond the lateral holding areas 315 and which are made from a flexible material such that the grip tip ends 361 are urged towards each other by a biasing action. Once the retaining member 34 is depressed downwards against the biasing action to be superimposed upon the stack of the seat sheets 33, the retaining member 34 will be clamped by the grip tip ends 361. Thus, as shown in FIG. 7, even if the amount of the stack of seat sheets 33 is reduced, the seat sheets 33 can still be steadily retained on the seat member 31 by the biasing action of the clamping members 36.

Further, the seat member 31 includes a pair of retaining posts 311 which are disposed on an upper major surface. 310 thereof proximate to two ends of the rear portion 312, respectively. A pair of holes 331 are formed in the stack of seat sheets 33 for passage of the retaining posts 311 therethrough. Moreover, each sheet 33 is provided with a tab 332 to be held by the user when separating the used sheet 33 from the stack. Preferably, each sheet 33 is coated with a waterproof layer on a lower major surface thereof.

Preferably, a shielding member 35 has a fourth rear portion which is pivotally mounted between the lid member 32 and the retaining member 34 about the axis so as to be superimposed upon the retaining member 34. The shielding member 35 is adapted to shield the entire stack of seat sheets 33 when the shielding member. 35 is superimposed upon the retaining member 34, such as when cleaning the toilet main body 30.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

We claim:

1. A toilet seat construction adapted to retain a stack of pliable seat sheets thereon, the stack of pliable seat sheets including a first front portion with two first ends, and first right and left portions respectively extending from the two first ends rearwards and spaced apart from each other in a longitudinal direction, the stack of the pliable seat sheets having a body contact area extending along the first right, left and front portions, and two lateral retained areas respectively extending along the first right, left and front portions and flanking the body contact area, said toilet seat construction comprising:

a seat member having a first upper major surface adapted for holding the stack of the pliable seat sheets thereon, and including second front and rear portions which are respectively provided with two second front ends and two second rear ends, and which are spaced apart from each other in a first direction transverse to the longitudinal direction, and second right and left portions which are spaced apart from each other in the longitudinal direction and which respectively interconnect said second front ends and said second rear ends, said first upper major surface having a raised area extending along said second right, left and front portions, and two lateral holding areas respectively extending along said second right, left and front portions and flanking said raised area, said first upper major surface being of a profile such that said raised area is disposed higher than said lateral holding areas while said lateral holding areas and said raised area are adapted to be superimposed by the lateral retained areas and the body contact area of the stack of the pliable seat sheets, respectively; and a retaining member having second upper and lower major surfaces opposite to each other in a second direction transverse to both the longitudinal and first directions, said second upper major surface including third front and rear portions respectively provided with two third front ends and two third rear ends, and spaced apart from each other in the first direction, said third rear portion being pivotally mounted and turnable relative to said first upper major surface about an axis parallel to the longitudinal direction and between a position of use, where said retaining member is superimposed upon said seat member, and a position of non-use, where said third front portion is remote from said second front portion, and third right and left portions spaced apart from each other in the longitudinal direction, and respectively interconnecting said third front ends and said third rear ends, said second upper major surface defining an opening which extends in the second direction through said lower major surface and which extends along said third right, left and front portions to form two lateral retaining portions that border said opening such that when said retaining member is in the position of use, said lateral retaining portions are superimposed respectively upon said lateral holding areas while the body contact area is urged by said raised area to protrude out of said opening.

2. The toilet seat construction of claim 1, wherein said retaining member further includes a plurality of protrusions which are formed on said lower major surface and along said lateral retaining portions.

3. The toilet seat construction of claim 1, further comprising a plurality of clamping members, each including a bottom strip which is mounted beneath said seat member and which extends to form two lateral edge portions, and two jaws which extend upwardly from said two lateral edge portions of said bottom strip and which are disposed outboard to said lateral holding areas, said jaws including two grip tip ends which extend respectively beyond said lateral holding areas and which are made from a material such that said grip tip ends are urged towards each other by a biasing action, and such that once said retaining member is depressed downwards against the biasing action to be superimposed upon the stack of the pliable seat sheets, said retaining member will be clamped by said grip tip ends.

4. The toilet seat construction of claim 1, wherein said seat member further includes a pair of retaining posts which are disposed on said first upper major surface proximate to said second rear ends of said second rear portion respectively and which are adapted to pass through the stack of the pliable seat sheets.

5. The toilet seat construction of claim 1, further comprising a shielding member having a fourth rear portion which is pivotally mounted and turnable relative to said second upper major surface about the axis so as to be superimposed upon said second upper major surface, said shielding member being of a dimension so as to be adapted to shield the stack of the pliable seat sheets when said shielding member is superimposed upon said second upper major surface.

* * * * *